United States Patent [19]

Fiddler

[11] Patent Number: 4,506,689

[45] Date of Patent: Mar. 26, 1985

[54] PORTABLE SUN SHELTER

[76] Inventor: Maurice K. Fiddler, 31 Hygeia Parade, Ringwood, Victoria, Australia

[21] Appl. No.: 412,440

[22] Filed: Aug. 27, 1982

Related U.S. Application Data

[60] Continuation-in-part of Ser. No. 376,488, May 10, 1982, Pat. No. 4,440,187, which is a division of Ser. No. 142,392, Apr. 21, 1980, Pat. No. 4,343,322.

[30] Foreign Application Priority Data

Sep. 2, 1981 [AU] Australia ..... PF0575

[51] Int. Cl.[3] ..... A47C 7/62

[52] U.S. Cl. ..... 135/109; 135/96; 135/117; 297/184; 24/458; 24/530

[58] Field of Search ..... 24/261 R, 3 J, 11 P, 24/255 R, 256; 135/96, 109, 117, 119, 90, 120; 297/184; 248/251; 280/47.38

[56] References Cited

U.S. PATENT DOCUMENTS

| | | | |
|---|---|---|---|
| 432,809 | 7/1890 | Weaver | 24/255 R |
| 1,566,920 | 12/1925 | Pie | 24/255 R |
| 1,720,109 | 7/1929 | Walk | 24/255 R |
| 2,041,588 | 5/1936 | Boling | 24/261 R |
| 2,889,607 | 6/1959 | Irving | 24/3 J |
| 2,932,833 | 4/1960 | Wambach | 135/96 |
| 4,043,528 | 8/1977 | Benoit et al. | 248/251 |
| 4,093,305 | 6/1978 | Staroste et al. | 297/184 |

FOREIGN PATENT DOCUMENTS

| | | | |
|---|---|---|---|
| 707953 | 4/1954 | United Kingdom | 297/184 |

*Primary Examiner*—Richard J. Apley
*Assistant Examiner*—S. Crow

[57] ABSTRACT

A foldable shelter has a framework with two major joints. A plurality of rib members, each of generally U-shaped configuration, is attached by the free ends of each rib member being connected at one of the major joints and the other free end being connected at the other major joint. A flexible cover is connected to the ribs and a clamp is coupled to each of the major joints for permitting the releasable attachment of the shelter to the framework of a lounge. The clamps are mounted rotatably with respect to the rib members and include wire springs which are pivotally mounted at respective joints. The axes of each of the respective joints intersect an axis of one of the major joints.

32 Claims, 5 Drawing Figures

PORTABLE SUN SHELTER

This application is a continuation-in-part of U.S. application Ser. No. 376,488 filed May 10, 1982, now U.S. Pat. No. 4,440,187 which is a division of U.S. application Ser. No. 142,392 filed Apr. 21, 1980, now U.S. Pat. No. 4,343,322.

BACKGROUND OF THE INVENTION

Field of the Invention

This invention relates to a foldable shelter for a lounge or chair.

The general object of the present invention is to provide a foldable shelter which serves as a sun shelter which can be removably attached to a lounge such as a sun lounge particularly sun lounges which have a framework formed from tubular members.

BRIEF DESCRIPTION OF THE INVENTION

According to the present invention there is provided a foldable shelter comprising a framework having two joints, a plurality of ribs each of generally U-shaped configuration, one of the free ends of each rib being connected at one of said joints and the other of the free ends of each rib being connected at the other of said joints, said joints permitting the ribs to be rotatable relative to one another and a flexible cover connected to the ribs characterized in that the joints include releasable mounting means for releasably attaching the shelter to the framework of a lounge.

Preferably, the releasable mounting means comprises clamps which include resilient elements which are adjustably connected to the joints so as to accommodate lounges having frames made from different sized members.

The invention will now be further described with reference to the accompanying drawings, in which:

DETAILED DESCRIPTION

Figure 1:
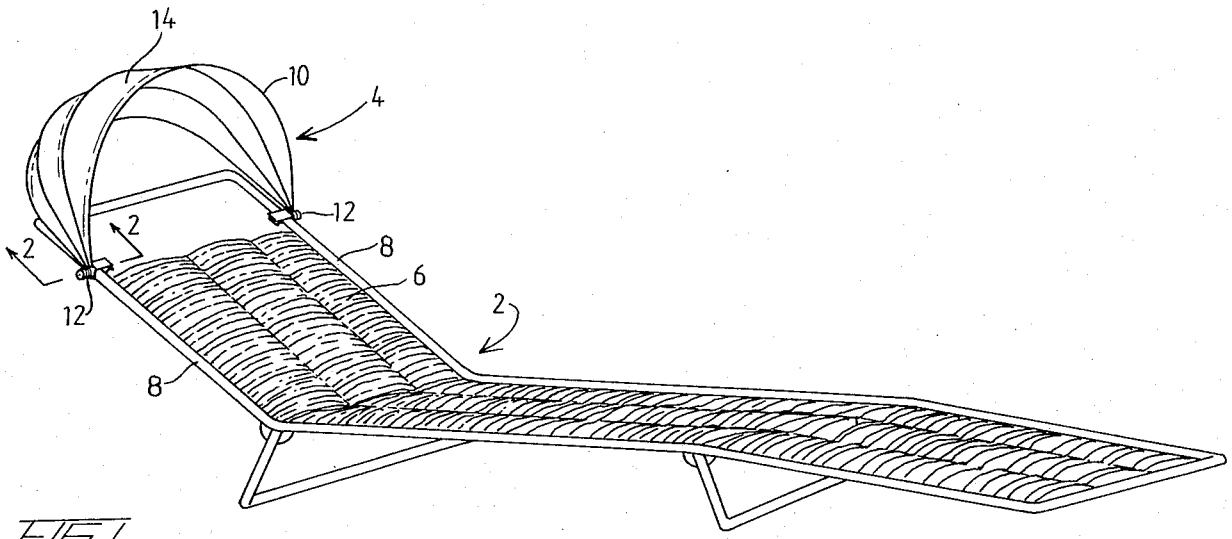
FIG. 1 is a perspective view of a lounge and shelter of the invention.

FIG. 1 shows a lounge 2 having a shelter 4 mounted thereon. The lounge has a back rest portion 6 having tubular members 8 at its side edges. The shelter 4 of the invention is mounted to the upward parts of the tubular members 8.

The shelter 4 includes a number of ribs 10 which are generally U-shaped and their lower ends are mounted in joints 12 located at either side thereof. A flexible cover 14 made from a suitable fabric is connected to the ribs so as to shade a person lying on the lounge.

Figure 3:
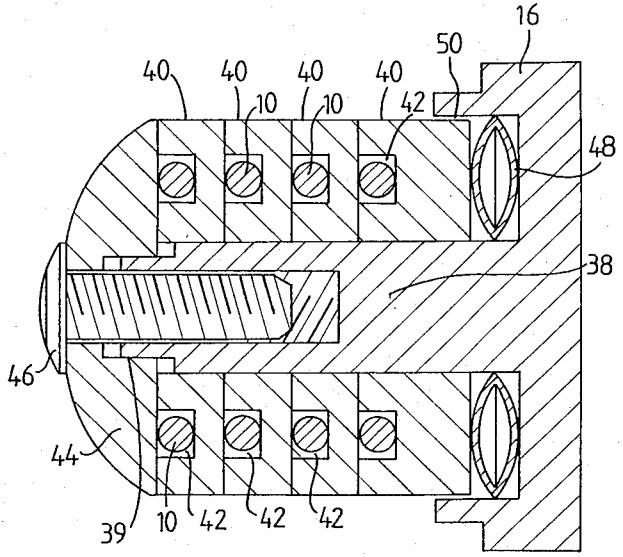
FIG. 3 is a sectional view taken along the line 3—3.
Figure 2:
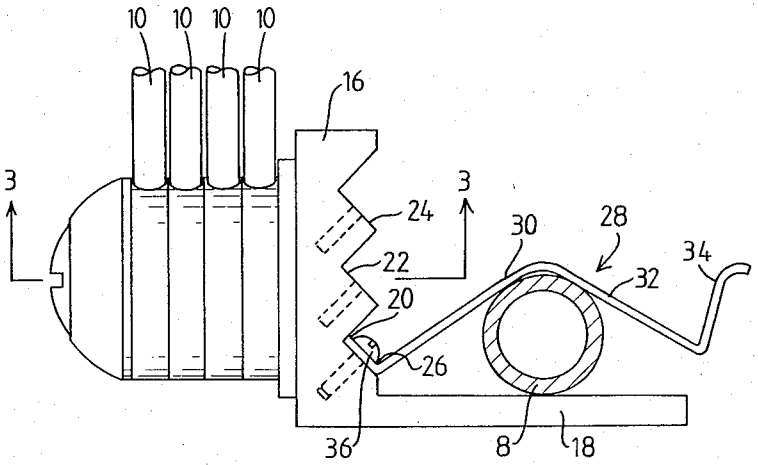
FIG. 2 is a view along the line 2—2 marked on FIG. 1.

One of the joints 12 is illustrated in greater detail in FIGS. 2 and 3. It will be seen that the joint 12 includes a body portion 16 integrally formed with an inwardly projecting leg 18. The body portion is also formed with three shoulders 20, 22 and 24 which serve as mounting surfaces for the bottom leg 26 of a broad leaf spring 28. The spring 28 includes main legs 30 and 32 which are generally perpendicular to one another and a terminal portion which extends away from the leg 32 generally in the direction of the leg 26. In use the joint 12 serves as a means of affixing the shelter 4 to the lounge by arranging for the uprights 8 of the lounge to be resiliently clamped between the clip 28 and the leg 18 of the joint. It will be seen that there is a relatively small radius between the legs 30 and 32 compared with the diameter of the member 8 so that there are effectively three points of contact with the tubular member 8. This has been found to render a firm grip on the tubular member 8. The curved terminal portion 34 assists in opening the spring when the upright 8 is to be clamped. The spring is connected to the shoulder 20 by screws 36. If the shelter 4 is to be used with a lounge having uprights of a larger size, the screws 36 can be removed and the leg 26 of the spring can be positioned on one or other of the shoulders 22 or 24.

It will be appreciated of course that the same type of joint can be used with non-circular uprights and indeed can be used on the side supports of a back rest of a chair such as a deck chair or the like.

The body 16 has a threaded spigot 38 extending from the opposite side as the leg 20. The spigot serves as a mounting for the ends of the ribs, in a similar manner to the arrangement disclosed in U.S. application Ser. No. 142,392 filed Apr. 21, 1980. Briefly, that arrangement includes a number of disc shaped carriers 40 mounted thereon, the carriers 40 being provided with annular recesses 42 in their outer faces, the recesses 42 receiving loops formed on the ends of the ribs 10. The carriers 40 are retained on the spigot 38 by means of a rounded cap 44 which in turn is held in position by means of a screw 46 threadably received within the spigot 38. The sides of the spigot 38 are formed with flats 39 which engage complementary surfaces on the cap 44 and stop rotation thereof. One or a pair of spring washers 48 is located between the inner most carrier 40 and the body 16 so that the carriers are resiliently clamped together on the spigot 38 and the clamping force can be adjusted by altering the setting of the screw 46. The inner most carrier 40 is somewhat wider than the remaining ones so as to provide a region 50 of overlap between it and the body 16 so as to prevent dirt, sand or other foreign material entering the space where the washers 48 are located.

It has been found that the joint illustrated in FIGS. 2 and 3 is particularly useful and neat in appearance and provides for ease of adjustment of the position of the ribs. In particular, it is possible for a user of the lounge with the shelter 4 fitted thereto to adjust the position of the shelter by merely clasping one of the ribs and moving it to the required position. There is no need to adjust wing nuts or the like.

Figure 5:
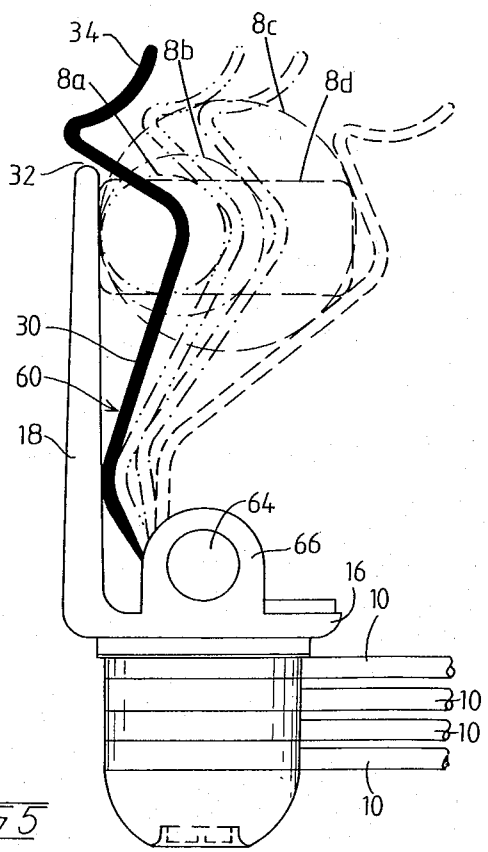
FIG. 5 shows the joint of FIG. 4 co-operating with lounge frames of differing dimensions.
Figure 4:
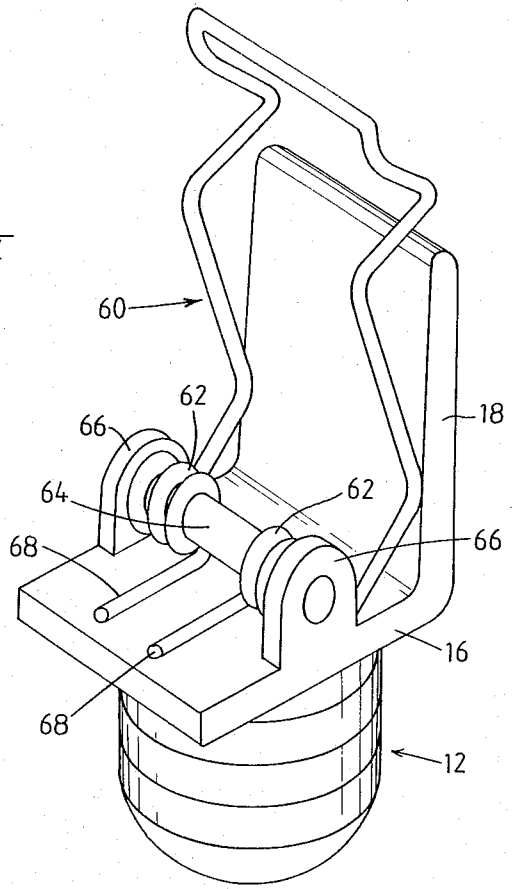
FIG. 4 is a perspective view of a modified form of joint.

FIGS. 4 and 5 illustrate a modified form for the joints 12, the same reference numerals being used where appropriate. In this arrangement, the broad leaf spring is replaced by a spring clip 60 which is formed from spring steel wire. The wire is formed with convolutions 62 which encircle a mounting shaft 64 which is connected to the body of the joint 16 by means of upstanding bosses 66. The convolutions 62 and shaft 64 form a simple form of pivotal connection. The main body of the clip 60 is generally U-shaped and as seen in side view in FIG. 5, as to have legs 30 and 32 which correspond to those of the spring 28. The clip is also formed with the curved terminal portion 34, as before. The free ends 68 of the clip bear against the body 16 and so bias the main body of the clip towards the leg 18.

FIG. 5 diagrammatically illustrates the manner in which the clip 62 can co-operate with tubular members 8*a*, 8*b* and 8*c* of different diameters. Further, the diagram also shows the clip co-operating with a frame member 8*d* of rectangular cross-section. The location of the shaft 64 spaced from the inward leg 18 is thought to assist in providing flexibility of operation. It will be noted that because of the generally perpendicular orientation of the legs 30 and 32 there is always at least two points of contact of the clip with the frame member. The configuration of the clip is also such that the legs 30, 32 are disposed at respective angles to the direction of extent of the leg 18. The two points of contact of the clip and frame member are thus always to opposite sides of a normal to the leg 18 at the point of contact of the frame member therewith. It is preferred that the spacing of the centre of the shaft from the adjacent face of the leg 18 be approximately 17 mm.

It is further preferred that the terminal portion of the spring 28 or clip 62 be located approximately 10 cm from the ribs 10 so that the user can grasp the ribs 10 in the fingers of one hand and use his thumb to grasp the terminal portion 34 and move it away from the leg 18 to assist entry of the frame of the lounge or chair. Of course the user can easily perform this operation with both joints simultaneously. This makes the device of the invention very convenient to use.

It will be further appreciated that the ribs 10 are resilient and by flexure thereof the shelter can be used with lounges and chairs of different widths.

Many modifications will be apparent to those skilled in the art without departing from the spirit and scope of the invention.

I claim:

1. A foldable shelter comprising a framework having two joints, a plurality of ribs each of generally U-shaped configuration, one of the free ends of each rib being connected at one of said joints and the other of the free ends of each rib being connected at the other of said joints, said joints permitting the ribs to be rotatable relative to one another and a flexible cover connected to the ribs, the joints including releasable mounting means for releasably attaching shelter to the framework of a lounge, said releasable mounting means comprising clamps which include springs which are pivotally mounted at respective said joints, and inwardly directed legs which co-operate with respective springs, said springs being biased towards the legs and extending inwardly, and generally in the directions of extent of the legs, from the locations at which they are mounted to the respective joints to terminal portions thereof adjacent the free ends of the legs, the ribs at end portions thereof adjacent the joints extending generally transversely to the directions of extent of the legs and springs, the terminal portions of said springs being spaced from said end portions of the ribs by a distance such that a user can separately open each said clamp by gripping with the fingers of one hand the ribs adjacent the respective clamp and manipulating with the thumb of the same hand the terminal portion of the spring of the clamp to move the terminal portion of the spring away from the co-operating leg, against resilient bias of the spring.

2. A shelter as claimed in claim 1 wherein the springs are formed with first leg portions which extend angularly away from the respective leg adjacent thereto and with second leg portions which extend angularly towards the respective leg adjacent thereto so that in use both the first and second leg portions of said spring will engage the framework of said lounge.

3. A shelter as claimed in claim 2 wherein the first and second leg portions extend approximately perpendicularly to one another.

4. A shelter as claimed in claim 1 wherein the ribs are resilient whereby the spacing between the joints can be altered by flexure of the ribs and the clamps can co-operate with frame members of lounges of difference widths.

5. A shelter as claimed in claim 3 wherein the ribs are resilient whereby the spacing between the joints can be altered by flexure of the ribs whereby the clamps can co-operate with frame members of lounges of different widths.

6. A foldable shelter comprising a framework having two joints, a first rib, a second rib and a plurality of intermediate ribs each of generally U-shaped configuration, a flexible cover connected to said ribs one end of the cover being connected to the first rib and other end of the cover being connected to the second rib, one of the ends of each rib being connected at one of said joints and the other of the ends of each rib being connected at the other of said joints, said joints permitting the ribs to be rotatable relative to one another, at least one of said joints including a number of rotatable carrier elements in which the ends of the ribs are mounted, said carrier elements being disc shaped with their outer surfaces lying substantially on a common cylindrical surface, and being provided with an annular recess into which a curved end portion of the free end of the ribs is located, the joints including releasable mounting means for releasably attaching the shelter to the framework of a lounge.

7. A shelter as claimed in claim 6 wherein the carrier elements are formed from plastic material.

8. A foldable shelter as claimed in claim 6 wherein the releasable mounting means comprises clamps which include springs which are pivotally mounted at respective joints said clamps including inwardly directed legs which co-operate with respective springs, said springs being biased towards the legs adjacent thereto.

9. A foldable shelter as claimed in claim 8 wherein the springs are formed with terminal portions which extend from the second leg portions generally in the direction of the first leg portions, the terminal portions being spaced from the ribs by a distance such that a user can grip the ribs with the fingers of one hand and manipulate the terminal portion with the thumb of the same hand.

10. A foldable shelter as claimed in claim 9 wherein the ribs are resilient whereby the spacing between the joints can be altered by flexure of the ribs whereby the clamps can co-operate with frame members of lounges of different widths.

11. A foldable shelter comprising a framework having two joints; first, second and a plurality of single-pieced intermediate ribs each being of U-shaped configuration and at least one rib having at least one curved end portion; a flexible cover connected to said ribs, one end of the cover being connected to the first rib and the other end of the cover being connected to the second rib, one of the ends of each rib being connected at one of said joints and the other of the ends of each rib being connected at the other of said joints, said joints permitting the ribs to be rotatable relative to one another at least one of said joints including a number of disc-shaped, coaxial, rotatable carrier elements to which the ends of the ribs are connected, at least one of said carrier elements having an annular recess into which said at least one curved end portion of said at least one of said ribs is received, the joints including releasable mounting means for releasably attaching the shelter to the framework of a lounge.

12. A foldable shelter as claimed in claim 11 wherein the releasable mounting means comprises clamps which include springs which are pivotally mounted at respective joints said clamps including inwardly directed legs which co-operate with respective springs, said springs being biased towards the legs adjacent thereto.

13. A foldable shelter as claimed in claim 12 wherein the springs are formed with terminal portions which extend the second leg portions generally in the direction of the first leg portions, the terminal portions being spaced from the ribs by a distance such that a user can grip the ribs with the fingers of one hand and manipulate the terminal portion with the thumb of the same hand.

14. A foldable shelter as claimed in claim 12 wherein the ribs are resilient whereby the spacing between the joints can be altered by flexure of the ribs whereby the clamps can co-operate with the frame members of lounges of different widths.

15. A foldable shelter comprising a framework having two joints, a first rib, a second rib and a plurality of single-pieced intermediate ribs each of U-shaped configuration, and at least one rib having at least one curved end portion, a flexible cover connected to said ribs, one end of the cover being connected to the first rib and the other end of the cover being connected to the second rib, one of the ends of each rib being connected at one of said joints and the other of the ends of each rib being connected at the other of said joints, said joints permitting the ribs to be rotatable relative to one another, at least one of said joints including a member of disc-shaped, coaxial, rotatable carrier elements to which ends of the ribs are connected, at least one of said carrier elements having an annular recess into which said at least one curved end portion of said at least one of said ribs is received and wherein said elements each have an axial width relative to its axis of rotation which is greater than the thickness of the rib connected thereto, whereby the ribs can be rotated so as to lie in a substantially common plane, the joints including releasable mounting means for releasably attaching the shelter to the framework of a lounge.

16. A shelter as claimed in claim 15 wherein the carrier elements are disc like and are provided with an annular recess into which a curved end portion of the free end of the ribs is located.

17. A foldable shelter as claimed in claim 15 wherein the releasable mounting means comprises clamps which include springs which are pivotally mounted at respective joints said clamps including inwardly directed legs which co-operate with respective springs, said springs being biased towards the legs adjacent thereto.

18. A foldable shelter as claimed in claim 17 wherein the springs are formed with terminal portions which extend from the second leg portions generally in the direction of the first leg portions the terminal portions being spaced from the ribs by a distance such that a user can grip the ribs with the fingers of one hand and manipulate the terminal portion with the thumb of the same hand.

19. A foldable shelter as claimed in claim 17 wherein the ribs are resilient whereby the spacing between the joints can be altered by flexure of the ribs whereby the clamps can co-operate with frame members of lounges of different widths.

20. A foldable shelter comprising a framework having two joints, first rib, second rib, and a plurality of intermediate ribs each of generally U-shaped configuration, a flexible cover connected to said ribs one end of the cover being connected to the first rib and the other end of the cover being connected to the second rib, one of the ends of each rib being connected at one of said joints and the other of the ends of each rib being connected at the other of said joints, said joints permitting the ribs to be rotatable relative to one another, at least one of said joints including a number of rotatable carrier elements in which the ends of the ribs are mounted, said carrier elements being disc shaped and formed from synthetic plastic material and said at least one joint includes spring means to apply resilient axial compressive forces to said rotatable carrier elements whereby said elements function as friction clutch members, the joints including releasable mounting means for releasably attaching the shelter to the framework of a lounge.

21. A shelter as claimed in claim 10 wherein the carrier elements are disc like and are provided with an annular recess into which a curved end portion of the free end of the ribs is located.

22. A shelter as claimed in claim 10 wherein said elements each have an axial width which is greater than the thickness of the rib connected thereto whereby the ribs can be rotated so as to lie in a common plane.

23. A shelter as claimed in claim 10 wherein washers of synthetic plastic material are interposed between at least some of the adjacent pairs of carrier elements whereby said washers will exert frictional forces on the carriers elements or ribs which frictional forces will tend to resist rotation of the carrier elements.

24. A foldable shelter as claimed in claim 20 wherein the releasable mounting means comprises clamps which include springs which are pivotally mounted at respective joints said clamps including inwardly directed legs which co-operate with respective springs, said springs being biased towards the legs adjacent thereto.

25. A foldable shelter as claimed in claim 24 wherein the springs are formed with terminal portions which extend from the second leg portions generally in the direction of the first leg portions, the terminal portions being spaced from the ribs by a distance such that a user can grip the ribs with the fingers of one hand and manipulate the terminal portion with the thumb of the same hand.

26. A foldable shelter as claimed in claim 24 wherein the ribs are resilient whereby the spacing between the joints can be altered by flexure of the ribs whereby the clamps can co-operate with frame members of lounges of different widths.

27. A shelter as claimed in claim 1 wherein the springs comprise leaf springs formed with mounting legs which are detachably mounted on a selected one of a plurality of spaced shoulders formed on said joints thereby altering the initial spacing of the springs from the adjacent legs.

28. A shelter as claimed in claim 1 wherein said springs comprise wire springs.

29. A foldable shelter comprising a framework having two major joints, a plurality of rib members each of generally U-shaped configuration, one of the free ends of each rib member being connected at one of said major joints and the other of the free ends of each rib member being connected at the other of said major joints, a flexible cover connected to the ribs and a releasable clamp coupled to each of said major joints for releasably attaching the shelter to the framework of a lounge, said clamps including wire springs which are pivotally mounted at respective joints, the axes of each said respective joints intersecting an axis of one of said major joints and said clamps being rotatably mounted relative to said rib members.

30. A shelter as claimed in claim 29, wherein the springs are formed with first legs which extend angularly away from the leg adjacent thereto and with second legs which extend angularly towards the leg adjacent thereto so that in use both the first and second legs will engage the frame members.

31. A shelter as claimed in claim 29, wherein the springs are formed with terminal portions which extend from the second legs generally in the direction of the first legs, the terminal portions being spaced from the ribs by a distance such that a user can grip the ribs with the fingers of one hand and manipulate the terminal portion with the thumb of the same hand.

32. A shelter as claimed in claim 29, wherein the rib members are resilient whereby the distance between the joints can be altered by flexure of the ribs whereby the clamps can co-operate with frame members of lounges of different widths.

* * * * *